US006783182B1

(12) United States Patent
Gallagher

(10) Patent No.: US 6,783,182 B1
(45) Date of Patent: Aug. 31, 2004

(54) MODULAR FURNITURE SYSTEMS AND METHODS

(76) Inventor: Michael S. Gallagher, 974 S. 200 E., Layton, UT (US) 84041

( * ) Notice: Subject to any disclaimer, the term of this patent is extended or adjusted under 35 U.S.C. 154(b) by 0 days.

(21) Appl. No.: 10/412,048

(22) Filed: Apr. 11, 2003

Related U.S. Application Data

(60) Provisional application No. 60/371,792, filed on Apr. 11, 2002.

(51) Int. Cl.[7] ..... A47C 4/02

(52) U.S. Cl. ..... 297/440.14; 297/440.2; 297/440.22; 297/440.23

(58) Field of Search ..... 297/440.1, 440.14, 297/440.2, 440.21, 440.22, 440.23

(56) References Cited

U.S. PATENT DOCUMENTS

| | | | | | |
|---|---|---|---|---|---|
| 1,718,321 | A | * | 6/1929 | Vericel | 297/440.21 |
| 2,164,715 | A | * | 7/1939 | Krainbill | 297/115 |
| 2,829,707 | A | | 4/1958 | Liebson | |
| 3,591,233 | A | * | 7/1971 | Turcksin | 297/440.11 |
| 3,608,959 | A | | 9/1971 | Sarvas | |
| 3,663,059 | A | | 5/1972 | Omlie | |
| 3,751,107 | A | | 8/1973 | Greitzer | |
| 4,074,919 | A | | 2/1978 | Watts | |
| 4,124,251 | A | * | 11/1978 | Petersen | 297/448.1 |
| 4,140,065 | A | | 2/1979 | Chacon | |
| 4,305,616 | A | | 12/1981 | Martinez | |
| 4,798,414 | A | * | 1/1989 | Hughes | 297/284.4 |
| 4,828,324 | A | | 5/1989 | Putnam | |
| 4,932,720 | A | * | 6/1990 | Sherman | 297/440.16 |
| 5,277,476 | A | * | 1/1994 | Caldwell | 297/440.1 |
| 5,423,597 | A | | 6/1995 | Rogers | |
| 5,522,182 | A | * | 6/1996 | Rogers | 52/9 |
| 5,601,340 | A | | 2/1997 | Stout | |
| 5,738,414 | A | | 4/1998 | Wieland et al. | |
| 5,765,922 | A | | 6/1998 | Hsia | |
| 5,775,778 | A | | 7/1998 | Riley et al. | |
| 5,890,767 | A | | 4/1999 | Chang | |
| 6,241,317 | B1 | * | 6/2001 | Wu | 297/440.23 |
| 6,568,058 | B1 | * | 5/2003 | Wieland et al. | 29/91.1 |
| 6,595,562 | B1 | * | 7/2003 | Wood | 292/307 A |

* cited by examiner

*Primary Examiner*—Peter M. Cuomo
*Assistant Examiner*—Joseph Edell
(74) *Attorney, Agent, or Firm*—Workman Nydegger

(57) ABSTRACT

A modular furniture system includes a first leg having an elongated top edge extending between an inside face and an opposing outside face. A first engagement channel is recessed along the top edge of first leg. A second leg is spaced apart from the first leg and has an elongated top edge extending between an inside face and an opposing outside face. A first engagement channel is also recessed along the top edge of the second leg. A seat frame includes a first side rail, a spaced apart second side rail, and at least one brace extending therebetween. The first side rail has a lower edge received within the first engagement channel of the first leg and the second side rail has a lower edge received within the first engagement channel of the second leg so as to removably secure the seat frame to the first and second leg.

32 Claims, 16 Drawing Sheets

MODULAR FURNITURE SYSTEMS AND METHODS

CROSS-REFERENCE TO RELATED APPLICATIONS

The present invention claims priority to U.S. Provisional Patent Application Ser. No. 60/371,792, filed Apr. 11, 2002, which is incorporated herein by specific reference.

BACKGROUND OF THE INVENTION

1. The Field of the Invention

The present invention relates to modular furniture systems and methods of assembly.

2. The Relevant Technology

Most traditional seating furniture, such as a chair or couch, comes in large fixed sections. Such furniture can be difficult to move in that it is typically odd shaped, large, and heavy. Furthermore, traditional furniture does not adapt well to placement in desired contours.

To address some of the above issues, various modular furniture systems have been designed. Although conventional modular furniture systems can typically be disassembled for ease in moving and storing, conventional systems have a number of shortcomings. For example, many conventional modular furniture systems are limited to the assembly of a single piece of furniture such as a set design for a chair or a couch. Other modular furniture systems require the extensive use of fasteners such as bolts or screws to enable the assembly. The required use of such fasteners adds material cost and significantly delays the assembly and disassembly.

To address the issue of placing furniture in a desired contour, modular couches have been designed. Such modular couches, however, are typically limited to a specific range of configurations. Furthermore, most modular couches are formed of rather large components which are themselves heavy and difficult to move.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

Figure 1:
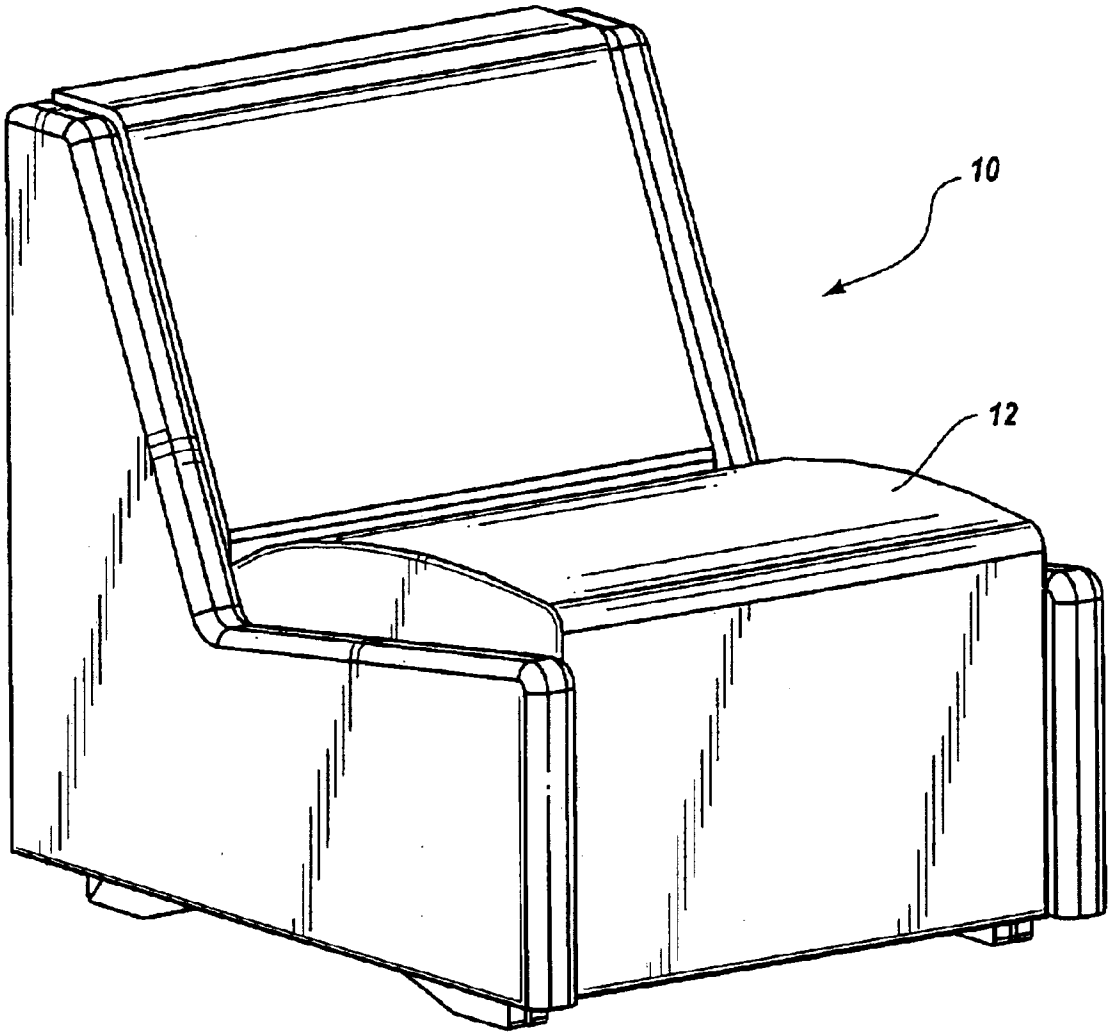
FIG. 1 is a perspective view of a modular furniture system assembled in the form of a chair.
Figure 2:
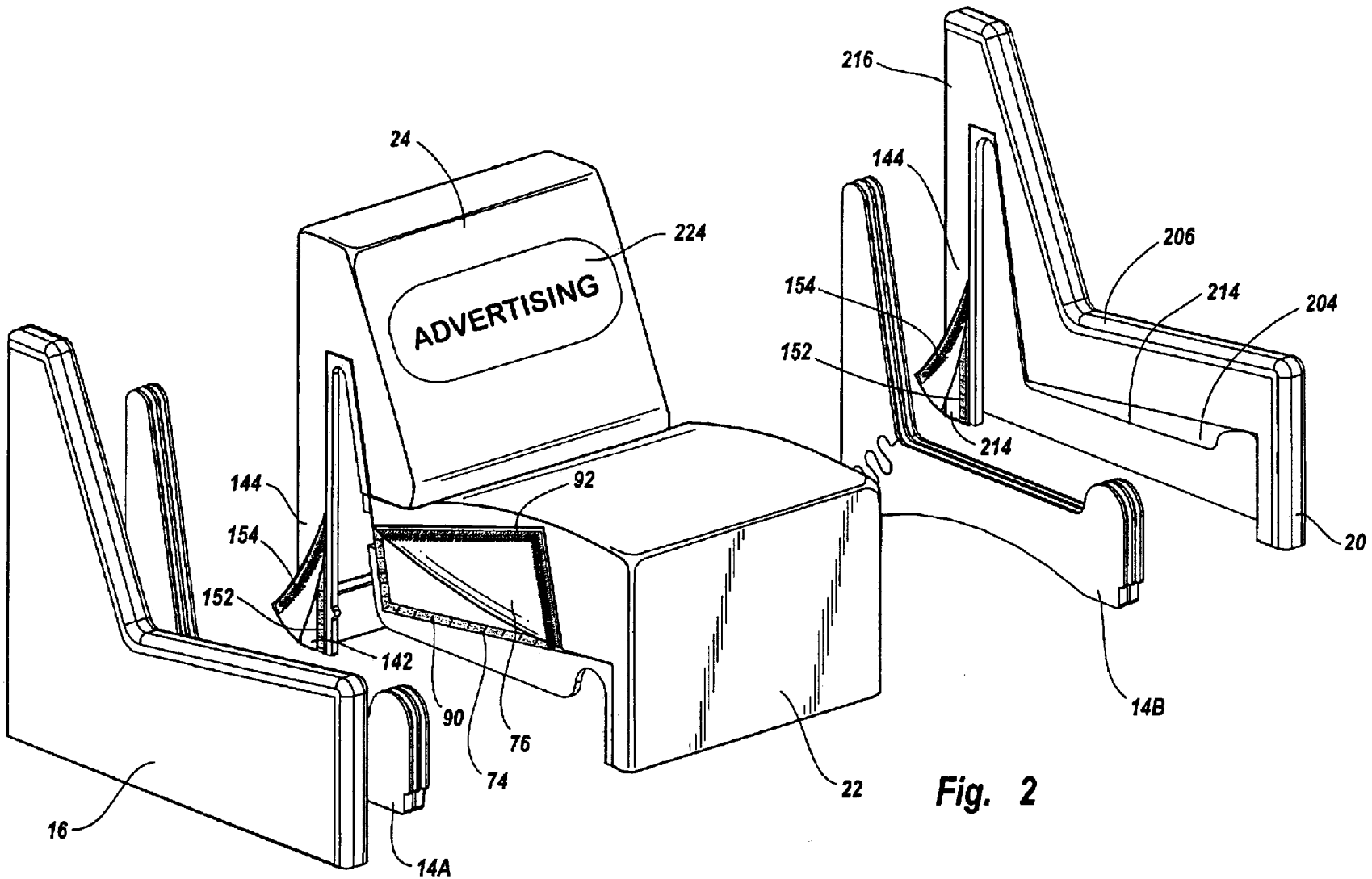
FIG. 2 is a perspective view of a partially exploded view of the chair shown in FIG. 1.

Depicted in FIG. 1 is one embodiment of select components of a modular furniture system 10 assembled in the form of a chair 12 and incorporating features of the present invention. As depicted in FIG. 2, chair 12 comprises a first leg 14A, a second leg 14B, a first arm rest 16, a second arm rest 20, a seat 22, and a back rest 24.

Figure 3:
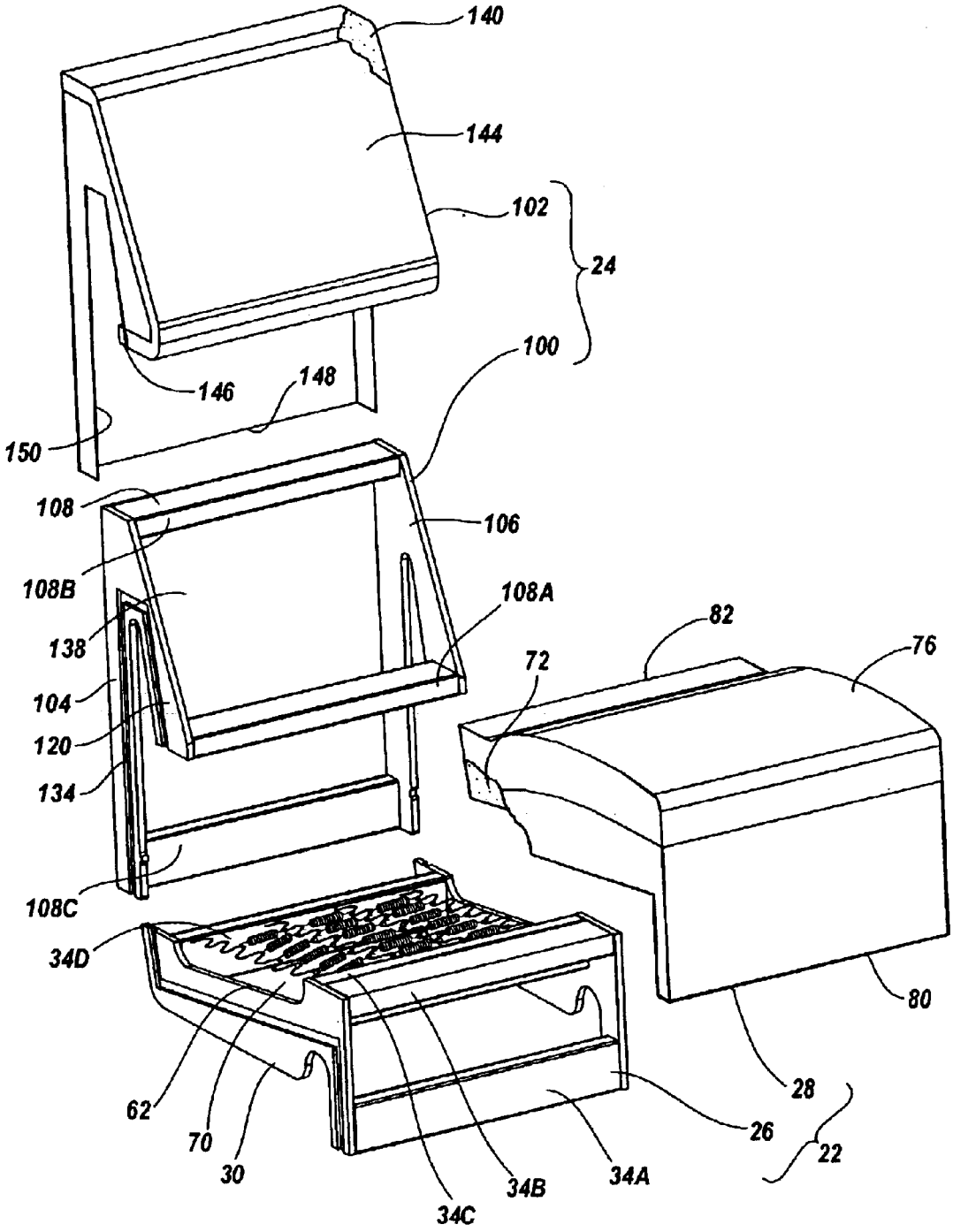
FIG. 3 is an exploded perspective view of the seat and back rest shown in FIG. 2.

As depicted in FIG. 3, seat 22 comprises a seat frame 26 and a seat cover assembly. 28. Seat frame 26 comprises a first side rail 30 and a spaced apart second side rail 32. Side rails 30 and 32 are disposed in substantially parallel alignment with braces 34 extending therebetween. Side rails 30 and 32 are typically made from flat board-like material having a thickness in a range between about 0.25 inches to about 1 inch. Other dimension can also be used. In one embodiment, side rails 30, 32 and braces 34 are formed from cut board, plywood, particle board or other wood based products. Alternatively, the members can be made from plastic, metal, composites or other desired material.

Figure 4:
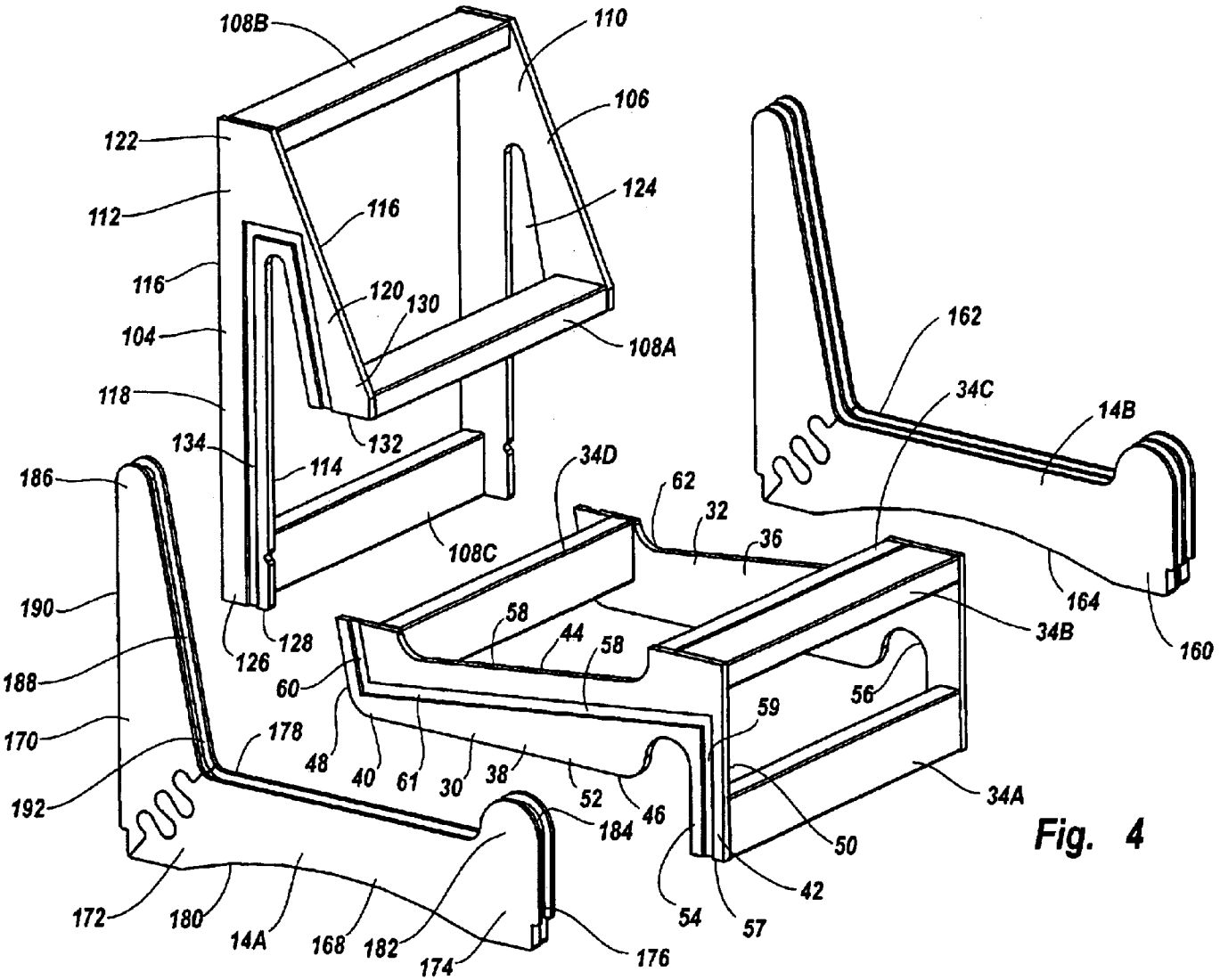
FIG. 4 is a perspective view of the seat frame, back frame, and legs of the chair shown in FIG. 2.

As depicted in FIG. 4, each of side rails 30 and 32 has an inside face 36 and an opposing outside face 38 longitudinally extending between a back end 40 and a front end 42. In general, side rails 30, 32 each have an upper edge 44 and an opposing lower edge 46 each extending at least partially between a back edge 48 and a front edge 50. With reference to the orientation as depicted in FIG. 4, side rails 30, 32 include an elongated, substantially horizontally disposed, substantially rectangular body section 52. An elongated, substantially vertically disposed foot section 54 is integrally formed with and projects orthogonally downward from body section 52 at front end 42. Side rails 30, 32 thus have a substantially L-shaped configuration. Foot section 54 terminates at a base edge 57 that extends between front edge 50 and lower edge 46.

As will be discussed below in greater detail, a rounded notch 56 upwardly extends on lower edge 46 of side rails 30, 32 at the intersection of body section 52 and foot section 54. Furthermore, although not required, an attachment channel 58 is recessed on outside face 38 and substantially extends along lower edge 46 and back edge 48. More specifically, attachment channel 58 includes a front section 59 upwardly extending along foot section 45 from base edge 57, a rear section 60 downwardly extending from upper edge 44 at back end 40, and a central section 61 extending between front section 59 and rear section 60.

As previously discussed, a plurality of braces 34 are secured to and extend between side rails 30 and 32. Braces 34 can be any desired length. In one embodiment, braces 34 are comprised of conventional 2×4 or other dimensioned members having a narrow aspect and a wide aspect. In other embodiments braces 34 can have any desired transverse cross sectional configuration such as square, round, irregular, or the like.

In the embodiment depicted, a brace 34A extends between side rails 30 and 32 at the lower end of foot sections 54 so that brace 34A is aligned with base edge 57, a narrow aspect of brace 34A being vertically oriented. A second brace 34B extends between side rails 30 and 32 at the upper end of foot sections 54 so that brace 34B is aligned with upper edge 44 and front edge 50, a wide aspect of brace 34B being vertically oriented. A third brace 34C extends between side rails 30 and 32 along the back end of second brace 34B so that the narrow aspect thereof is vertically oriented, Finally, a fourth brace 34D extends between side rails 30 and 32 at back end 40 so that brace 34D is aligned with upper edge 44, a narrow aspect of brace 34A being vertically oriented. An elongated groove 62 is recessed along upper edge 44 of the side rails 30 and 32 between brace 34C and brace 34D.

Returning to FIG. 3, braces 34C, 34D and side rails 30 and 32 bound a central seat opening 70. In one embodiment resiliently flexible springs 64 extend between braces 34C and 34D so as to span seat opening 70. Springs 64 are configured to resiliently bias upward to provide flexible support for seat 22. Springs 64 can be a variety of different configurations and can alternatively be replaced with rigid supports, cable, bands, cord, or other forms of supports that span across seating opening 70.

Seat cover assembly 28 is selectively mounted on seat frame 26. In one embodiment, seat cover assembly 28 comprises padding 72 having a primary cover 74 (FIG. 2) and a secondary cover 76 disposed thereover. Padding 72 can comprise foam padding or any other type of seat padding. Covers 74 and 76 have substantially the same configuration and are designed to fit over padding 72 and seat frame 26. Covers 74, 76 can be made of any type of flexible material such as leather, woven material, polymeric sheets, or the like.

Each of covers 74, 76 has a front edge 80, a back edge 82 and opposing side edges 84 extending therebetween. Once padding 72 is secured or otherwise disposed on seat frame 26, primary cover 74 is tightly pulled over padding 72 and secured to seat frame 26. Specifically, side edges 84 of primary cover 74 are secured within corresponding attachment channels 58 of side rails 30 and 32. Back edge 82 is secured along brace 34D while front edge 80 is secured along the bottom of brace 34A. Primary cover 74 can be secured by staples, tacks, or any other conventional type of fastener.

In one embodiment of the present invention means are provided from removably securing secondary cover 76 to seat frame 26. By way of example and not by limitation, in general VELCRO and its equivalents comprise a hook strap and a loop strap which when pressed together releasably engage. As depicted in FIGS. 2 and 3, loop strap 90 (FIG. 2) is secured to seat frame 26 along or over top of the secured edges 80, 82, and 84 of primary cover 74. For example, loop strap 90 is secured within attachment channels 58 and along braces 34A and 34D. Loop strap 90 can be secured using any conventional methods such as staples, tacks, adhesive and the like. A hook strap 92 (FIG. 2) is secured along the perimeter edges of secondary cover 76. As a result, secondary cover 76 can be selectively pulled over primary cover 74 and secured in place by engaging hook strap 92 with corresponding sections of loop strap 90. In alternative embodiments, the positioning of loop strap 90 and hook strap 92 can be reversed. Furthermore, straps 90 and 92 can be replaced buttons, snaps, single loops and hooks, and other conventional types of catches and fasteners.

Depicted in FIG. 3, back rest 24 comprises a back frame 100 and a back cover assembly 102. Back frame 100 comprises a first side panel 104 and a spaced apart second side panel 106. Side panels 104 and 106 are disposed in substantially parallel alignment with braces 108 extending therebetween. Side panels 104, 106 and braces 108 are typically made from the same materials having substantially the same thicknesses as previously discussed with regard to side rails 30, 32 and braces 34, respectively.

As depicted in FIG. 4, each side panel 104, 106 has an inside face 110 and an opposing outside face 112 which each extend between an inner edge 114 and an outer edge 116. Side panels 104, 106 have a substantially j-shaped configuration which includes an elongated back arm 118 and an elongated front arm 120 which are angled related to each other. Arms 118 and 120 intersect at an upper end 122 and bound a substantially U- or V-shaped catch 124 formed therebetween. Back arm 118 is longer than front arm 120 and has a lower end 126 that terminates at a base edge 128. Front arm 120 also has a lower end 130 that terminates at a base edge 132.

Although not required, an attachment channel 136 is recessed on outside face 112 of each side panel 104, 106 so as to extend along inner edge 114. Specifically, attachment channel 136 extends up along back arm 118 from base edge 128, passes around catch 124, and then extends down front arm 120 to base edge 132.

Braces 108 comprise a first brace 108A which extends between lower ends 130 of front arms 120 so as to be partially aligned with base edges 132 and outer edges 116, first brace 108A being oriented so that the wide aspect is vertically oriented. A second brace 108B extends between upper ends 122 of side panels 104, 106 with second brace 108B being at least partially aligned with outer edge 116, second brace 108B being oriented so that the wide aspect is vertically oriented. Finally, a third brace 108C extends between lower ends 126 of back arms 118 so as to be partially aligned with base edges 128 and outer edge 116, third brace 108C being oriented so that the narrow aspect is vertically oriented.

Returning to FIG. 3, braces 108A, 108B and side panels 104 and 106 bound a central back opening 138. In one embodiment resiliently flexible springs 64, as discussed with seat 22, can be positioned so as to extend between braces 108A, 108B or side panels 104, 106 so as to span back opening 138. Springs 64 would resiliently bias outward so as to provide flexible support for back rest 24. Again springs 64 can be a variety of different configurations and can alternatively be replaced with rigid supports, cable, bands, cord, or other forms of supports that span across back opening 138. In yet other embodiments, a sheet or material and/or padding can be directly spaced across back opening 138 without further support.

Back cover assembly 102 is selectively mounted on back frame 100. In one embodiment, back cover assembly 102 comprises padding 140 having a primary cover 142 (FIG. 2) and a secondary cover 144 disposed thereover. Padding 140 and covers 142, 144 can be comprised of the same materials as discussed above with regard to padding 72 and covers 74, 76, respectively.

Each of covers 142 and 144 is designed to fit over padding 140 and back frame 100 and includes a front edge 146, aback edge 148, and opposing side edges 150 extending therebetween. Once padding 140 is secured or otherwise disposed on back frame 100, primary cover 142 is tightly pulled over padding 140 and secured to back frame 100. Specifically, side edges 150 of primary cover 142 are secured within corresponding attachment channels 134 of side panels 104 and 106. Back edge 148 is secured along the bottom of brace 108C while front edge 80 is secured along the bottom of brace 108A. Again, primary cover 142 can be secured by staples, tacks, or any other conventional type of fastener.

In one embodiment of the present invention means are provided from removably securing secondary cover to back frame 100. By way of example and not by limitation, a loop strap 152 is secured to back frame 100 along or over top of the secured edges 146, 148, and 150 of primary cover 142. For example, loop strap 152 is secured within attachment channels 134 and along the bottom of braces 108A and 108C. Loop strap 152 can be secured using any conventional methods such as staples, tacks, adhesive and the like. A hook strap 154 is secured along the perimeter edges of secondary cover 144. As a result, secondary cover 144 can be selectively pulled over primary cover 142 and secured in place by engaging hook strap 154 with corresponding sections of loop strap 152. In alternative embodiments, the positioning of loop strap 152 and hook strap 154 can be reversed. Furthermore, straps 152 and 154 can be replaced buttons, snaps, single loops and hooks, and other conventional types of catches and fasteners.

With reference to FIG. 2, seat 22 and back rest 24 are removably mounted to legs 14A and 14B which have the same configuration. As depicted in FIG. 4, legs 14 are made from a substantially flat board-like material and have a substantially L-shaped configuration. Legs 14 typically have a thickness in a range between about 0.5 inches to about 2.5 inches, although other dimensions can also be used, and are typically made from the same types of materials as discussed above with regard to side rails 30 and 32.

Legs 14 have an inside face 160, an opposing outside face 162, and a perimeter edge 164 extending therebetween. In general, legs 14 comprise an elongated base portion 168 and an elongated back portion 170 upstanding therefrom. More specifically, base portion 168 has a first end 172 and an opposing second end 174. Second end 174 terminates at a terminal-edge 176. Base portion 168 also has a top edge 178 and an opposing bottom edge 180 extending along the length thereof. Upwardly projecting from top edge 178 at second end 174 is a rounded stop portion 182 having an outer edge 184.

Back portion 170 upwardly extends from first end 172 of base portion 168 and terminates at a rounded head 186. Back portion 170 has a front edge 188 and an opposing back edge 190 which intersect at head 186. It is appreciated that base portion 168 and back portion 170 can be formed as separate discrete members that are secured together or can be integrally formed as a single member.

Figure 5:
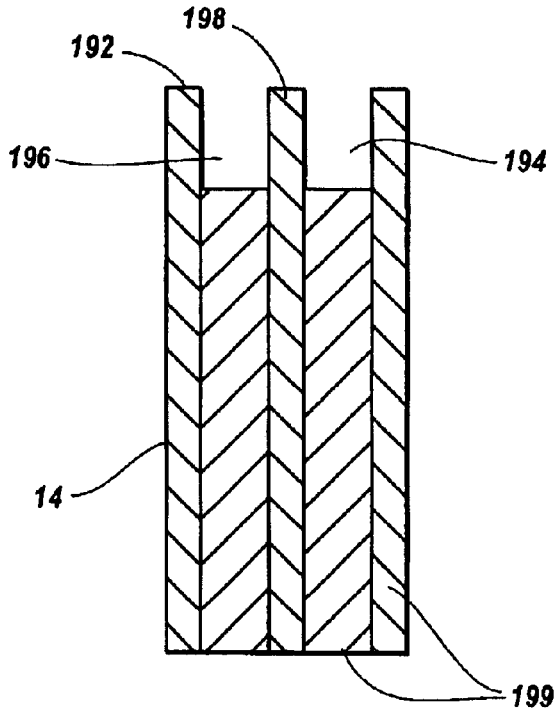
FIG. 5 is a cross sectional side view of the leg shown in FIG. 4.

Edges 176, 178, 184, 188 and 190 of legs 14 as discussed above, are cumulatively referred to as engagement edge 192. As depicted in FIG. 5 an inner engagement channel 194 and spaced apart outer engagement channel 196 are recessed into and extend along engagement edge 192. A partition ridge 198 is formed between channels 194 and 196 and also extends along engagement edge 192. In one embodiment, channels 194 and 196 each have a depth and a width in a range between about 0.25 inches to about 0.75 inches. Partition ridge 198 typically has a width of about 0.25 inches. Again, other dimensions for the engagement channels and partition ridge can also be used.

Figure 6:
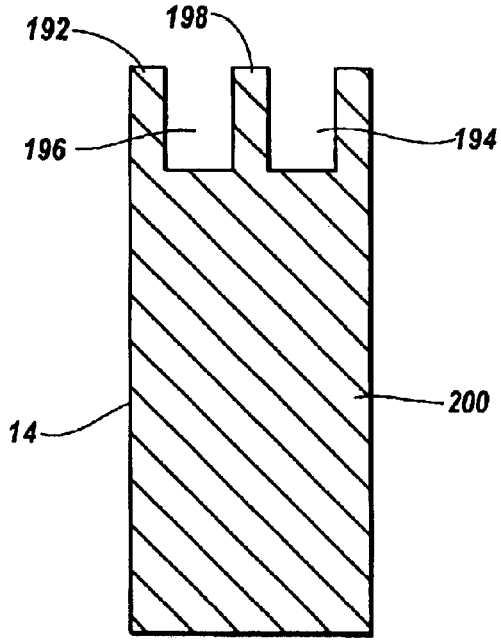
FIG. 6 is a cross sectional side view of an alternative embodiment of the leg shown in FIG. 5.

As illustrated by FIG. 5, channels 194 and 196 can be formed by producing legs 14 out of multiple panels 199 of different height. Alternatively, as depicted in FIG. 6, legs 14 can be made out of a single panel 200 where channels 194 and 196 are formed by routing or are otherwise cut into panel 200.

Figure 7:
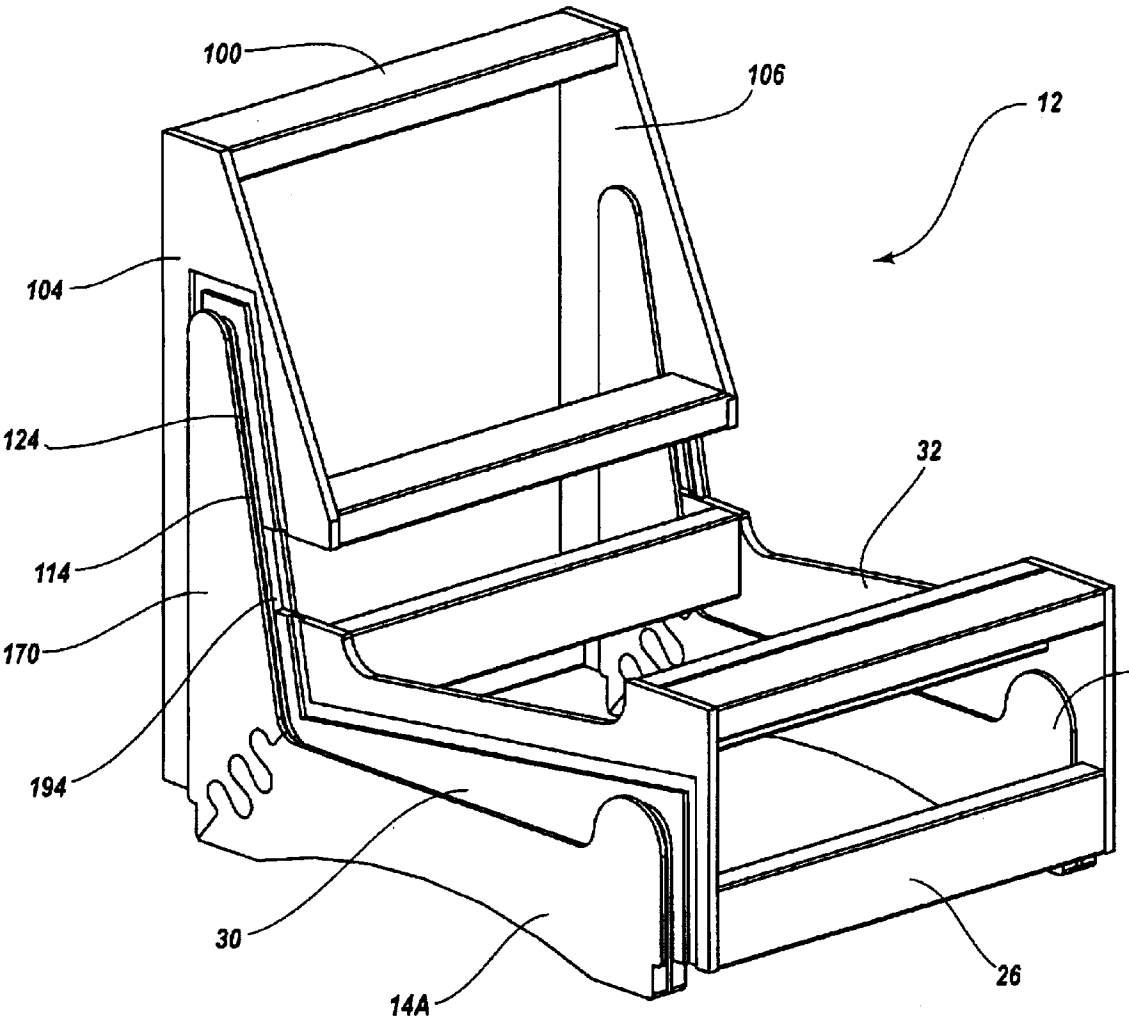
FIG. 7 is a front perspective view of the seat frame, back frame, and legs shown in FIG. 4 in an assembled configuration.

As depicted in FIG. 7, chair 12 is assembled by removably inserting side rails 30 and 32 of seat frame 26 into inner engagement channel 194 of legs 14A and 14B, respectively. More specifically, lower edge 46 of side rail 30 is received within engagement channel 194 of leg 14A so that stop portion 182 of leg 14A is received within notch 56 of side rail 30. In this configuration back edge 48 of side rail 30 is received within engagement channel 194. In one embodiment side rail 30 and engagement channel 194 have substantially the same width so that a snug engagement is formed therebetween. A slight tolerance between rail 30 and channel 194 can also be formed for ease in assembly and disassembly. Alternatively, significant play can also be formed between rail 30 and channel 194.

The same assembly is also performed between leg 14B and side panel 32. This assembly results in a gravity set, stable, self-supporting structure. That is seat frame 26 and thus seat 22 is stable and self-support on legs 14A and 14B for its intended use without the required use of any fasteners such as screws, nails, bolts, or the like extending between seat frame 26 and legs 14A and/or 14B. Although such fasteners can be used to prevent unwanted disassembly, they are not required for normal use. It is appreciated that seat frame 26 is depicted in FIG. 7 and other figures without cover assembly 28 for clarity in showing the assembly. In practical use, however, seat frame 26 would typically be coupled with cover assembly 28 prior to mounting on legs 14A and 14B.

In one embodiment of the present invention, means are provided for preventing seat 22 or seat frame 26 from sliding on legs 14A and 14B. By way of example and not by limitation, stop portion 182 and notch 56, as discussed above, are formed to complementary engage so as to prevent seat frame 26 from sliding on legs 14A and 14B. It is appreciated that there are a variety of alternative embodiments which can be used to accomplish the same function. For example, stop portion 182 and complementary notch 56 need not be disposed at second end 174 of legs 14 but can be disposed at any position along base portion 168 of legs 14. Furthermore, the elements can be reversed so that stop portion 182 projects from side rail 30, 32, while notch 56 is recessed on legs 14. Furthermore, the stop portion and corresponding notch can be virtually any desired shape and/or size. In yet other embodiments, the stop portion and corresponding notch can be replaced within mechanical fasteners which secure the side rails 30, 32 to legs 14 to prevent sliding.

In other embodiments of the present invention, it is appreciated that means to prevent sliding are not required. For example, stop portion 182 and corresponding notch 56 can be eliminated. Frictional engagement between legs 14 and side rails 30, 32 would be sufficient under normal use to prevent unwanted sliding.

As also depicted in FIG. 7, chair 12 is further assembled by removably inserting side panels 104 and 106 of back frame 100 into inner engagement channel 194 of legs 14A and 14B, respectively. More specifically, back portion 170 of leg 14A is received within catch 124 of side panel 104 so that inner edge 114 of side panel 104 is received within engagement channel 194 of leg 14A. Leg 14B and side panel 106 are similarly assembled.

The above assembly results in a gravity set, stable, self-supporting structure. That is back frame 100 and thus back rest 24 is stable and self-support on legs 14A and 14B for its intended use without the required use of any fasteners such as screws, nails, bolts, or the like extending between back frame 100 and legs 14A and/or 14B. Although such fasteners can be used to prevent unwanted disassembly, they are not required for normal use. It is again appreciated that back frame 100 is shown in FIG. 7 and other figures without cover assembly 102 for clarity in showing the assembly. In practical use, however, back frame 100 would be coupled with cover assembly 102 prior to mounting on legs 14B and 14B.

Figure 8:
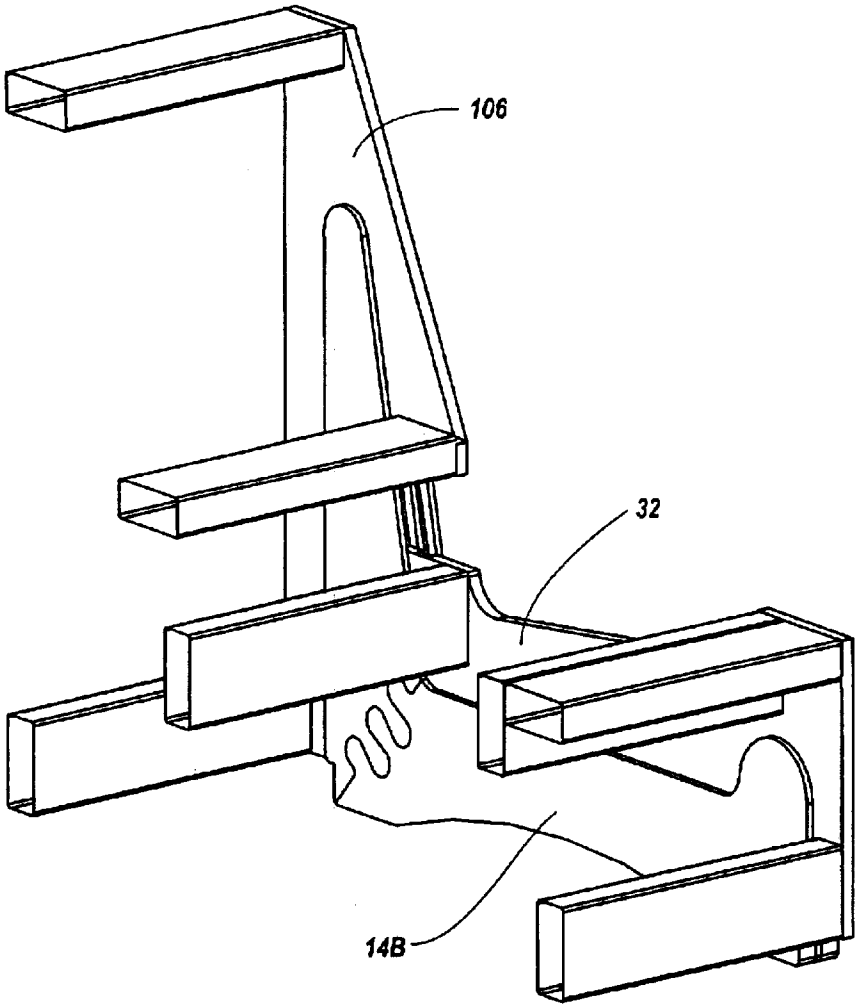
FIG. 8 is a perspective cross sectional view of the assembly shown in FIG. 7.
Figure 9:
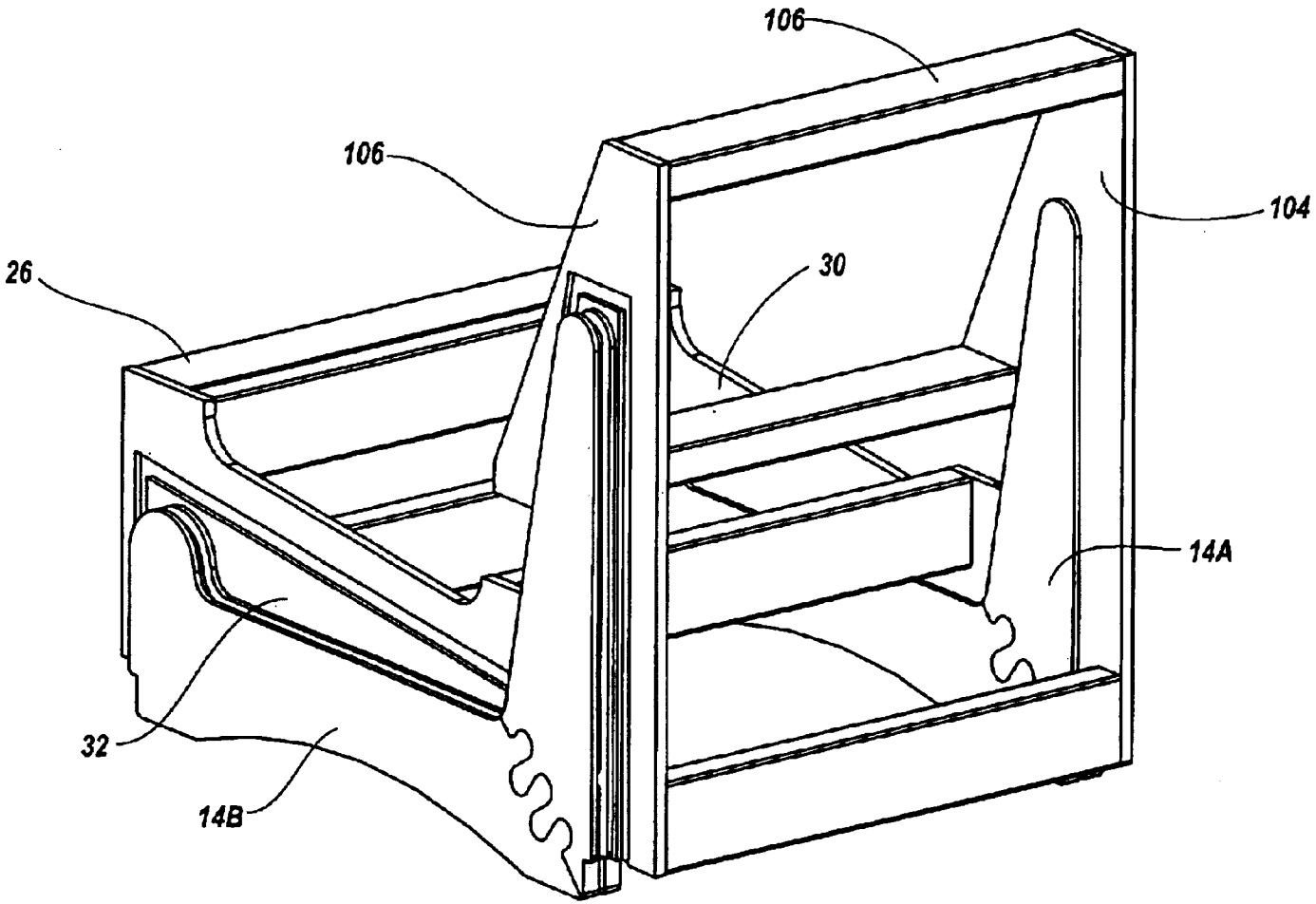
FIG. 9 is a back perspective view of the assembly shown in FIG. 7.

Depicted in FIGS. 8 and 9 are alternative perspectives showing the assembly of seat frame 26, back frame 100, and legs 14A and 14B.

Figure 10:
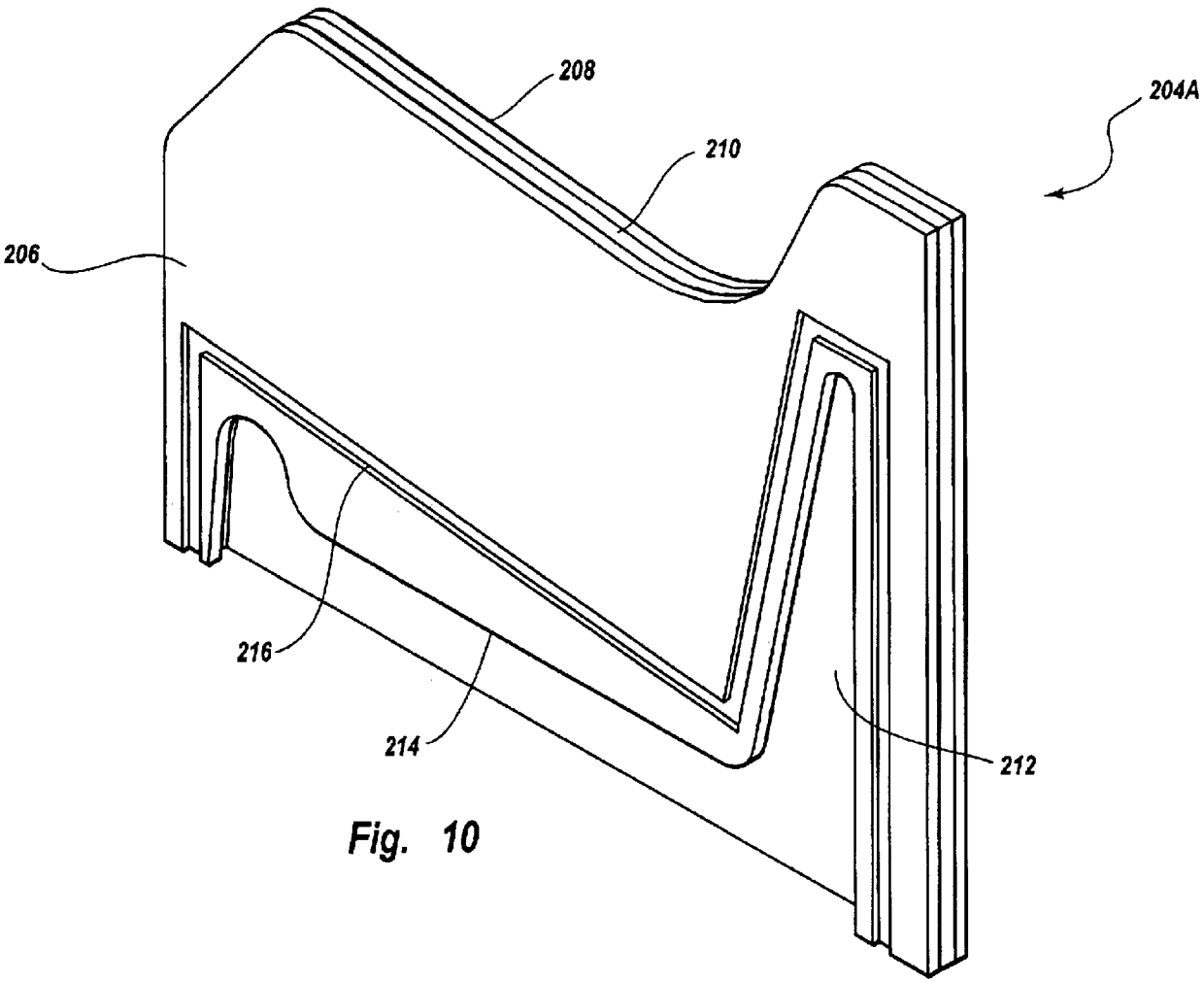
FIG. 10 is a perspective view of an arm frame.

Returning to FIGS. 1 and 2, selectively and removably mounted on legs 14 and 18 are arm rests 16 and 20. Each arm rest 16, 20 comprises an arm frame 204 and an arm cover assembly 206 secured thereto. Ann rests 16 and 20 are shown having a low profile configuration while an arm frame 204A, shown in FIG. 10, has a high profile configuration. Frame 204A is comprised of an inside panel 206, a spaced apart outside panel 208, and a spacer 210 disposed therebetween. A cavity 212 is formed between panels 206 and 208. Inside panel 206 has a retention edge 214 formed thereon. Retention edge 214 has a configuration complementary to engagement channel 196 formed on legs 14. An attachment channel 216 is recessed on inside panel 206 so as to follow along retention edge 214 at a spaced apart position.

Returning to FIG. 2, arm frame 204 has the same configuration and elements as arm frame 204A except that it has a slightly lower profile. As such, like elements are identified by like reference characters. As with seat 22 and back rest 24, arm cover assembly 206 can include but does not require padding (not shown) that can be disposed on arm frame 204, a primary cover 214, and a secondary cover 216. Means are also provided for removably securing secondary cover 216 to arm frame 204. This means comprises the same alternatives as previously discussed with regard to seat 22 and back rest 24.

During assembly, retention edge 214 of arm rests 16 and 20 are slid into the complementary outer engagement channels 196 of legs 14A and 14B, respectively. This removable attachment results in the complete assembly of chair 12 as shown in FIG. 1.

As discussed above, seat 22, back rest 24 and arm rests 16 and 20 include a primary cover that is fixed and a secondary cover that is selectively removable. There are several benefits for having the removable secondary cover. For example, as the secondary cover becomes worn or damaged, it can easily be replaced with a new secondary cover. The secondary cover can also be removed, cleaned, and replaced. Furthermore, the secondary cover can be produced having advertising 224 (FIG. 2) or the like in any form, shape, or color printed or otherwise formed thereon. Accordingly, secondary covers having different adverting, messages, information, or other types of promotions or artistic designs can be readily used and readily replaced as needed. The above benefits are especially desirable where the modular furniture is used in a commercial setting. For example, the modular furniture can be used in airports, bus stops, restaurants, and other commercial or populated settings where advertising space can be sold on the secondary covers.

In alternative embodiments, particularly in non-commercial uses, the secondary covers are not required. That is, the modular furniture can be desired only for use with the primary cover. In this embodiment, the means for removably attaching the secondary covers is also not required. Furthermore, the various attachment channels, such as attachment channels 58, 134, and 216 can be eliminated. The attachment channels are designed to provide additional space to receive the hook and loop straps or other means for removably connecting so that arm rests 16 and 20 can be snuggly disposed against the side of seat 22 and back rest 24 when secondary covers are used. As such, when secondary covers are not used, the attachment channels can still be used but are not required. It is also appreciated that hook and loop straps or other attachment mechanisms can be used to removably connect the primary cover to the seat frame and the back frame.

Figure 11:
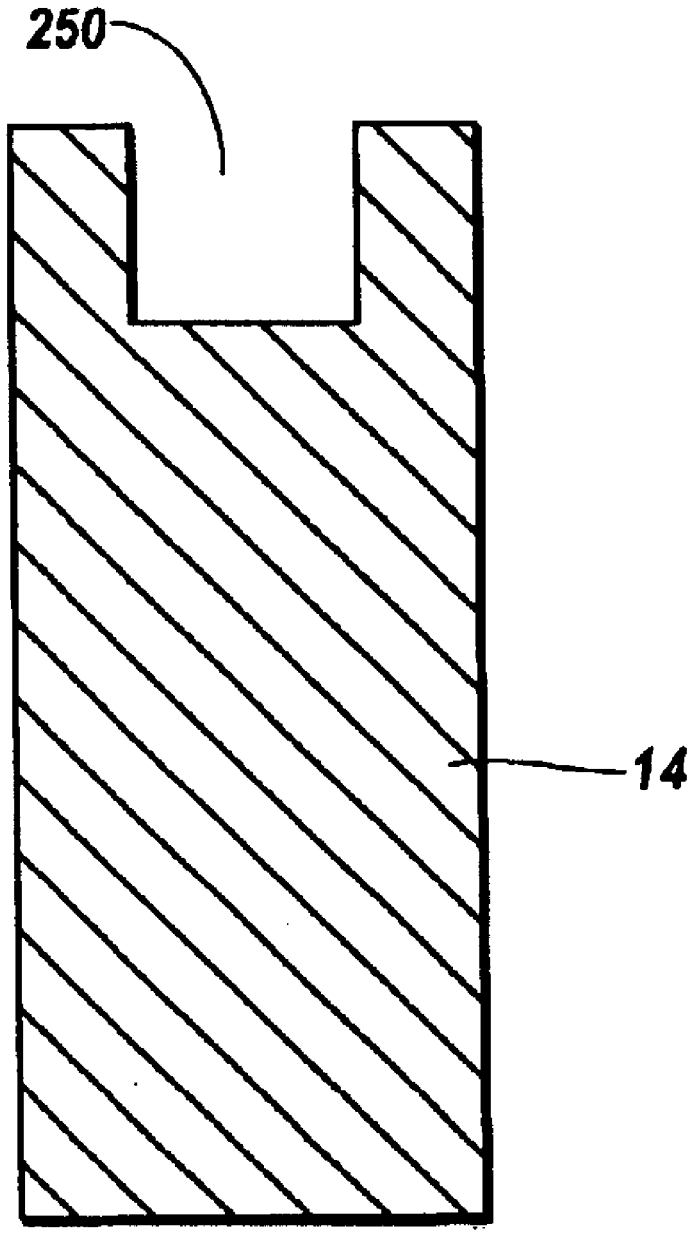
FIG. 11 is a cross sectional side view if an alternative embodiment of a leg.

It is further envisioned that secondary covers can be used without the use of the attachment channels. That is by increasing the width of partition ridge 198 (FIG. 5) additional space is provided for accommodating the secondary cover and the means for removably attaching the secondary cover without the required use of the attachment channels. In yet another alternative embodiment as depicted in FIG. 11, leg 14 can be made having a single engagement channel 250 extending along the length thereof. In one design, engagement channel 250 is wide enough to receive the edges from two furniture components such as the edges from two side rails 30 or the edges from a side rail and an arm rest. In yet another embodiment, where it is desirable not to put an arm rest at the end of an assembly, engagement channel 250 can be wide enough only to receive the edge of a single side rail. In this embodiment, the outer face of leg 14 could have a primary cover and secondary cover secured thereto.

Figure 12:
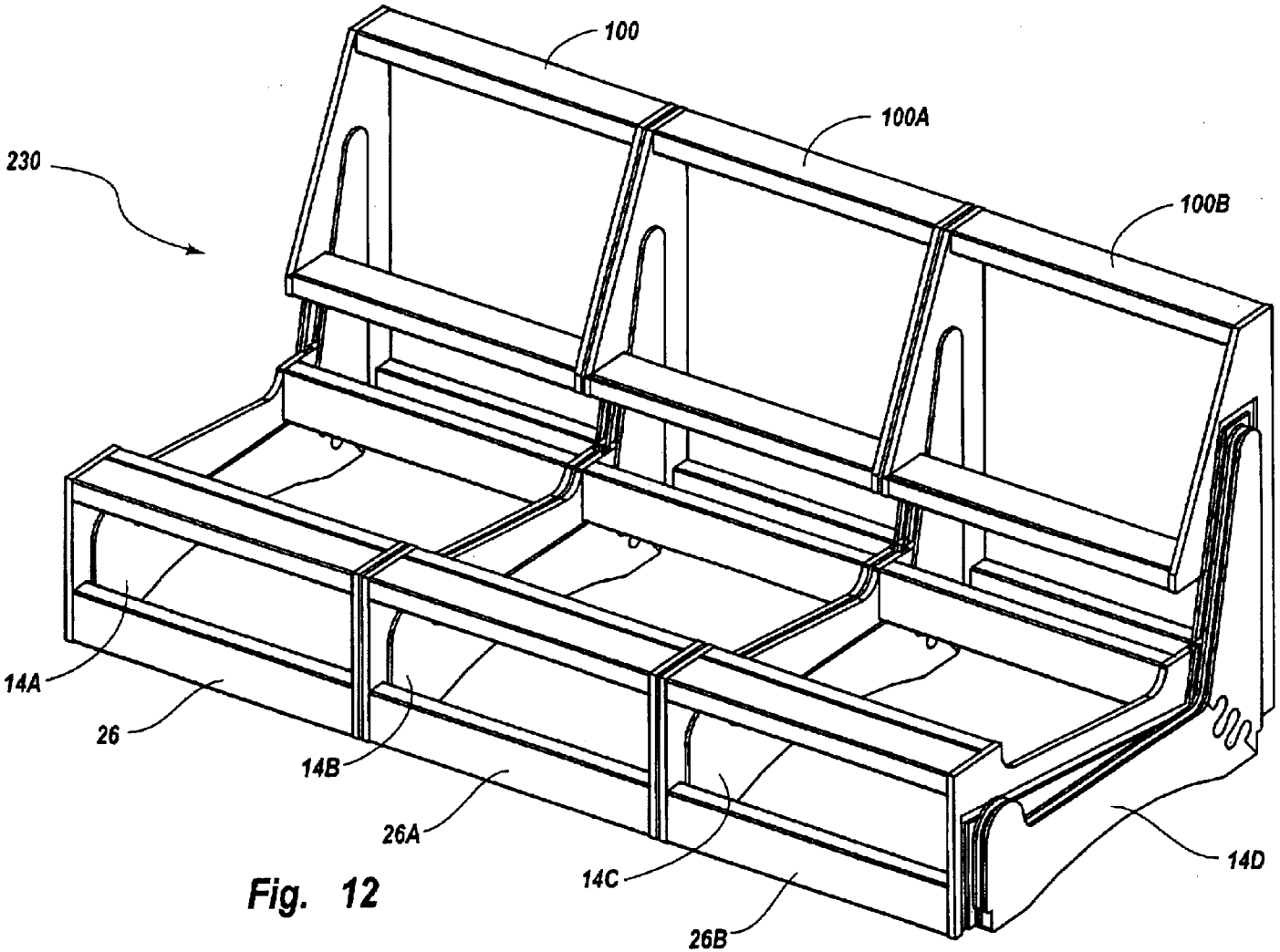
FIG. 12 is a perspective view of the modular furniture system assembled in the form of a couch.

Chair 12 is only one of many alternative configurations for which modular furniture system 10 can be assembled. For example, depicted in FIG. 12 a couch 230 is formed by coupling a seat frame 26A and back frame 100A to outer engagement channel 194 of leg 14B. This is accomplished in the same way that arm rest 20 was mounted to leg 14B. In turn, a new leg 14C is used to couple seat frame 26A with another seat frame 26B and couple back frame 100A with another back frame 100B. The various furniture components can be added indefinitely to obtain a couch of a desired length. If desired, arm rests can then be mounted on the opposing ends of the couch 230. In this embodiment, all of the seat frames, back frames and legs have a substantially identical configuration so that they can be assembled in any order. It is also noted that the back frames can be mounted to the legs before or after the seat frames are mounted to the legs.

Figure 14:
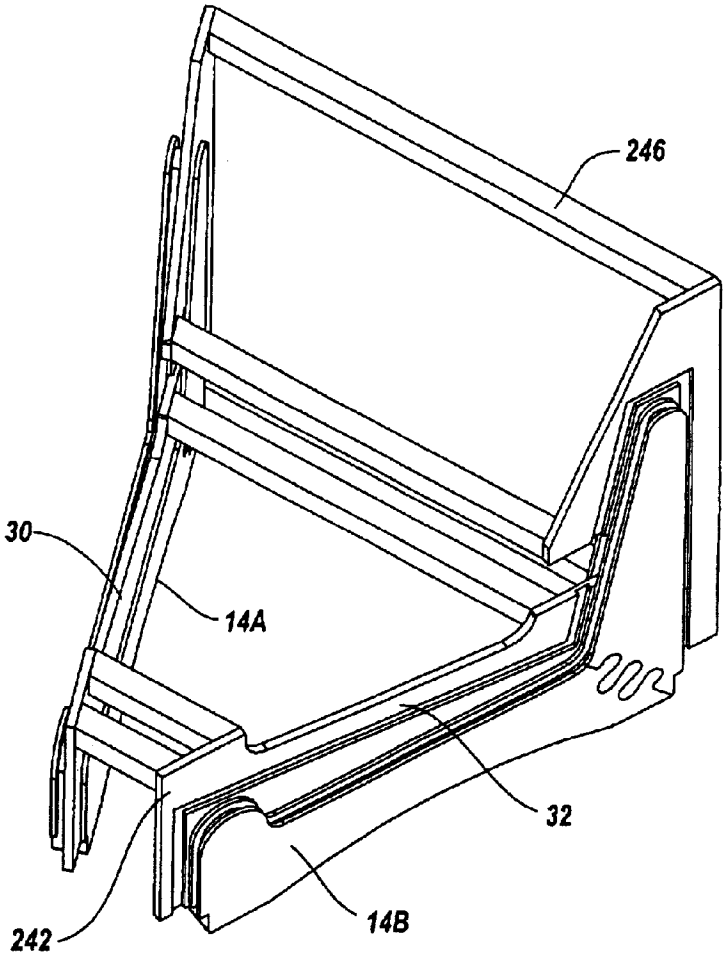
FIG. 14 is a perspective view of another alternative embodiment of a seat frame and back frame mounted to legs.
Figure 13:
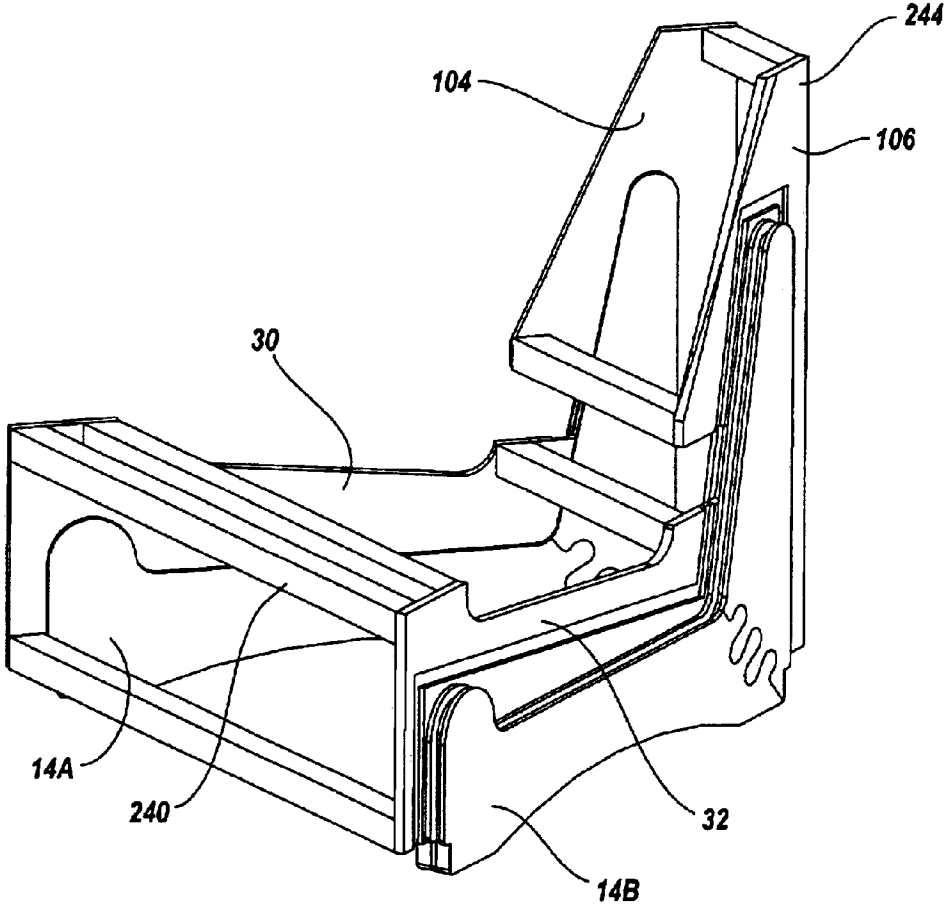
FIG. 13 is a perspective view of an alternative embodiment of a seat frame and back frame mounted to legs.

In contrast to having all of the seat frames and back frames the same configuration, it is also appreciated that seat frames and back frames of different configurations can be used. In the discussed alternative embodiments, like elements of different components are identified by like reference characters. For example, depicted in FIG. 13 is a seat frame 240 having side rails 30 and 32 as previously discussed. Seat frame 240 is distinguished from seat frame 26 in that side rails are no longer disposed in parallel alignment but rather are disposed at diverging angles such that side rails 30 and 32 are spaced apart father at the front end than at the opposing back end. In contrast, a seat frame 242 is shown in FIG. 14 wherein the side rails 30 and 32 diverge in an opposing direction. That is, side rails 30 and 32 are spaced apart father at the back end than at the opposing front end.

A back frame 244 is shown in FIG. 13 where side panels 104 and 106 are also disposed in a diverging orientation.

That is, side panels 104 and 106 are spaced apart father at the front end than at the opposing back end. In contrast, a back frame 246 is shown in FIG. 14 wherein the side panels 104 and 106 diverge in an opposing direction. That is, side panels 104 and 106 are spaced apart father at the back end than at the opposing front end. It is appreciated that the various diverging side rails and side panels can be positioned at any desired angle. By way of example, the side and panels can be disposed in intersecting planes that form an inside angle of 30°, 45°, 60°, or any other desired angle.

Figure 15:
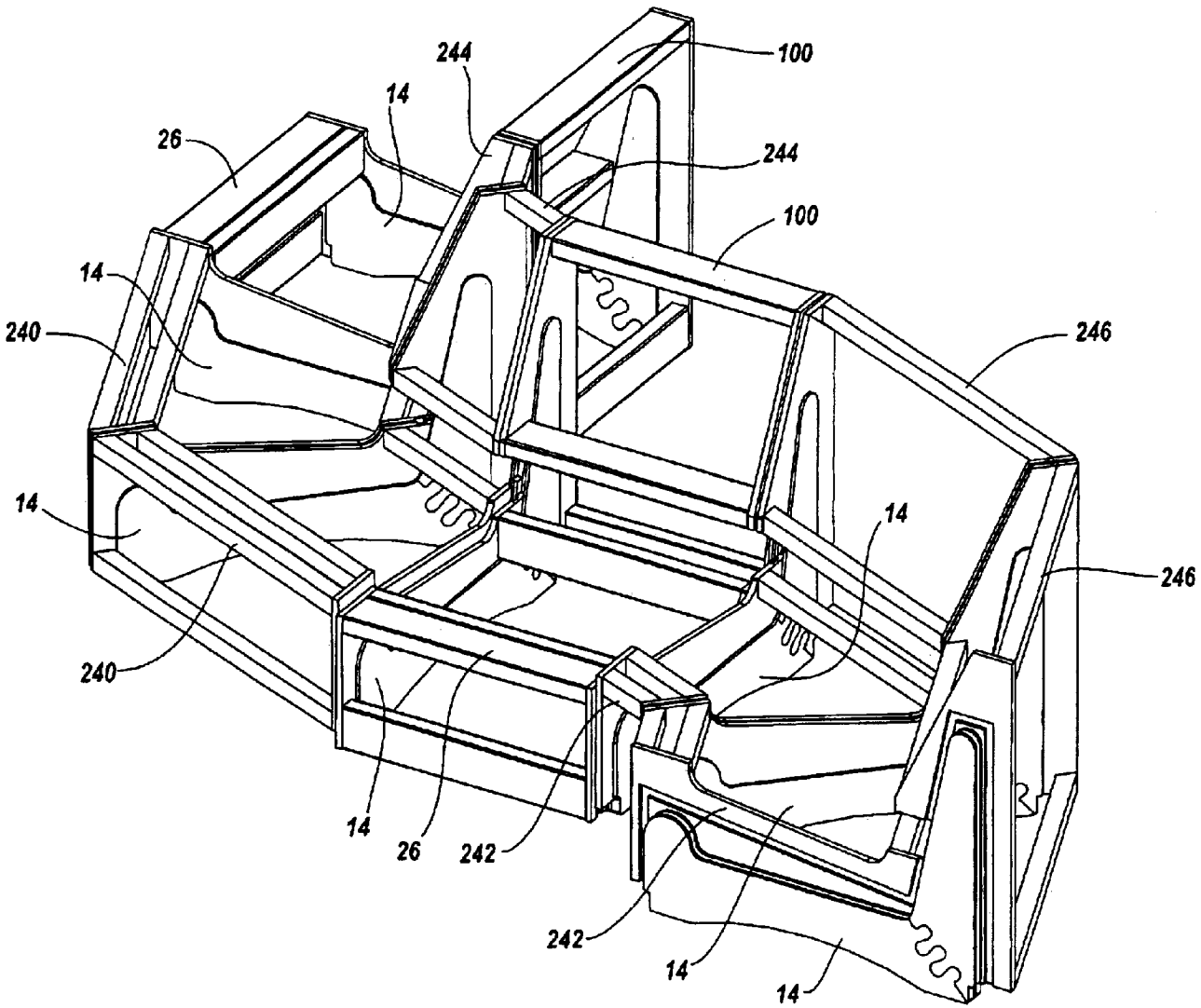
FIG. 15 is a perspective view of the modular furniture system assembled in a contoured configuration.
Figure 16D:
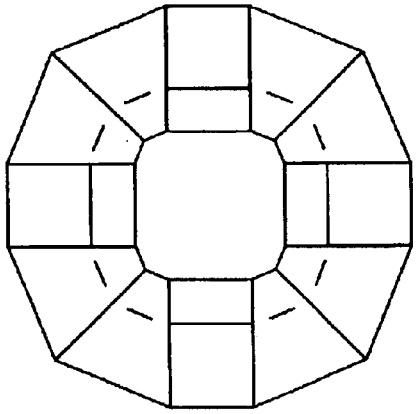
FIGS. 16A–16D are top plan views of alternative assemblies for the modular furniture system.
Figure 16C:
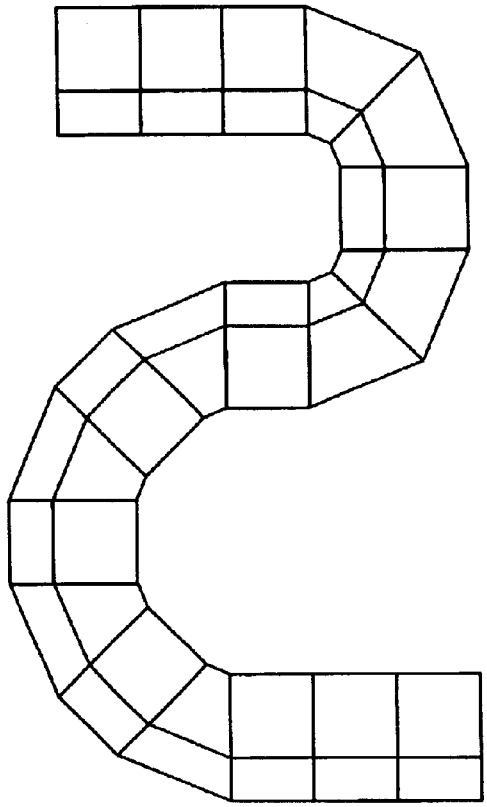
Figure 16B:
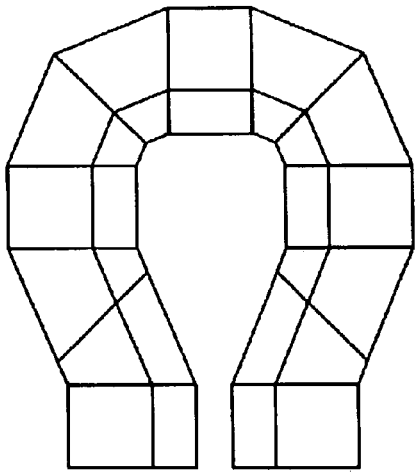
Figure 16A:
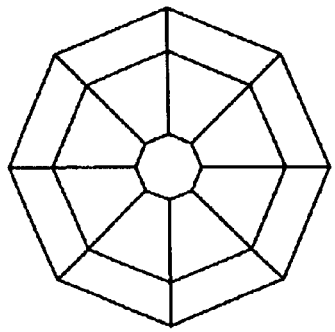

By mixing and matching the various alternative configurations for the seat frames and back frames, furniture assemblies can be easily produced having linear or curved configurations. For example, depicted in FIG. 15 is one assembly showing the use of the different seat frames and back frames with common legs 14. Depicted in FIG. 16A–16D are yet other alternative designs for modular furniture system 10. Using the various components, it is thus appreciated that a variety of different designs having any desired length can be made.

Figure 17:
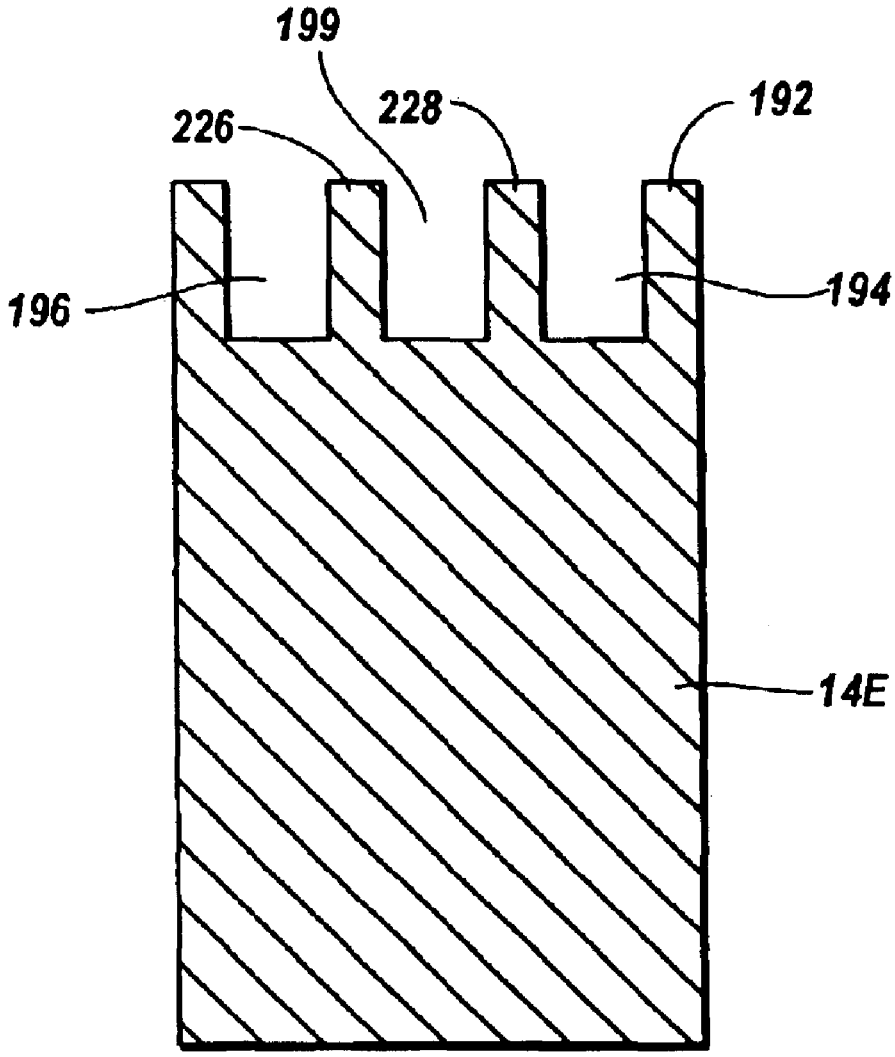
FIG. 17 is a cross sectional side view of an alternative embodiment of a leg.

Depicted in FIG. 17 is yet another alternative embodiment of a leg 14E. In this embodiment, leg 14E has a central engagement channel 218 disposed between engagement channels 194 and 196 and extending along leg 14. The engagement channels are separated by partition ridges 226 and 228. In like manner, any number of engagement channels can be formed on engagement edge 192 of leg 14E.

Figure 18:
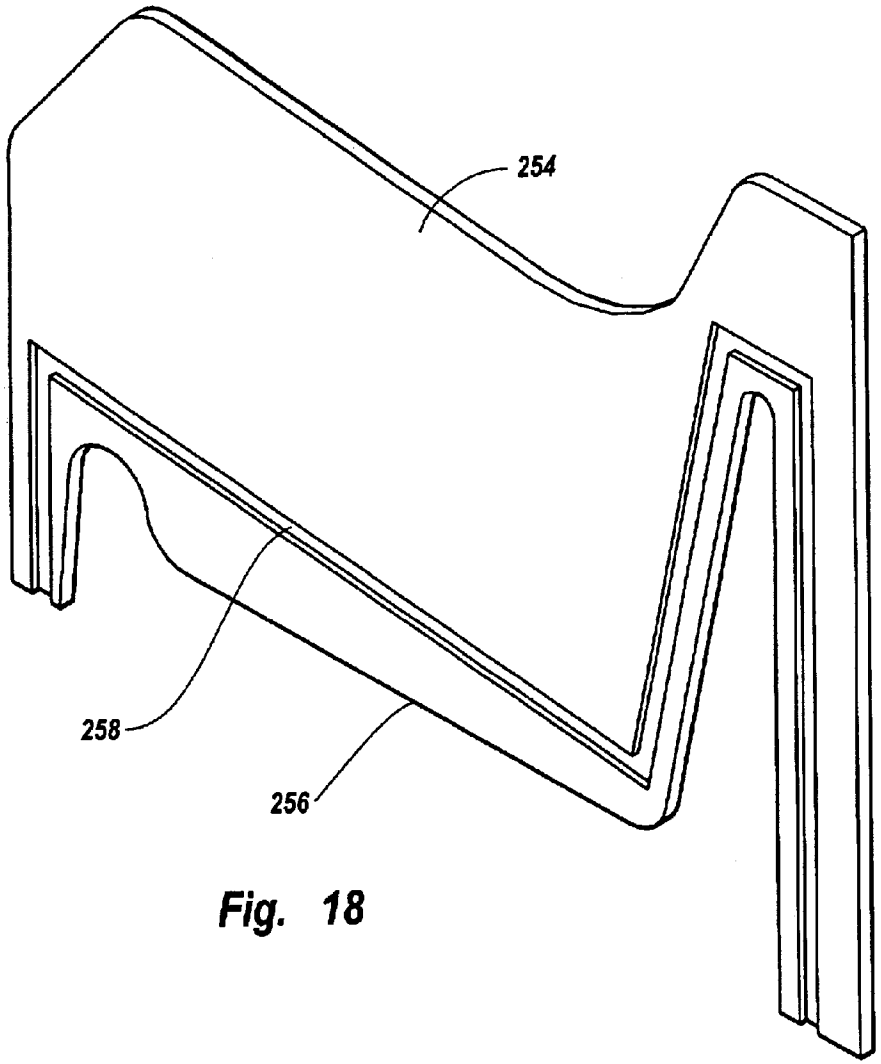
FIG. 18 is a perspective view of an alternative embodiment of an arm frame.

In one embodiment, engagement channel 218 can be used for supporting an arm rest between two seat frames or other furniture components. For example, depicted in FIG. 18 is an arm frame 254 formed of a single panel. Arm frame 254 has a retention edge 256 having a configuration complementary to central engagement channel 218 of leg 14E. If desired, attachment channels 258 can be formed on each side of arm frame 254 along retention edge 256. Padding, a primary cover, and, if desired, a secondary cover can also be mounted on arm frame 254 in the same manner as discussed above. Accordingly, by using leg 14E, arm frame 254 can be mounted in central engagement channel 218 while other furniture components, such as seat frames, can be-mounted in engagement channels 194 and 196.

In view of the foregoing, modular furniture system 10 provides a quick and efficient way of assembling, disassembling, and rearranging furniture components into any desired furniture configuration without the required use of mechanical fasteners such as screws, bolts, nails, or the like.

The present invention may be embodied in other specific forms without departing from its spirit or essential characteristics. For example, in all of the above discussed embodiments, the engagement channels are formed on the legs while the seat frame, back frame, and arm frame form the edges that are received within the channels. In other embodiments it is appreciated that this could be reversed so that the engagement channels are formed on the seat frame, back frame and arm frame while edges received within the channels are formed on the legs. The described embodiments are thus to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A modular furniture system comprising:

a first leg having an elongated top edge disposed between an inside face and an opposing outside face, an elongated first engagement channel of the first leg being recessed along at least a portion of the top edge of the first leg so that the first engagement channel of the first leg extends longitudinally along the top edge of the first leg;

a second leg spaced apart from the first leg, the second leg having an elongated top edge disposed between an inside face and an opposing outside face, an elongated first engagement channel of the second leg being recessed along at least a portion of the top edge of the second leg so that the first engagement channel of the second leg extends longitudinally along the top edge of the second leg; and a seat frame comprising a first side rail, a spaced apart second side rail, and at least one brace extending therebetween, the first side rail having a lower edge received within the first engagement channel of the first leg and the second side rail having a lower edge received within the first engagement channel of the second leg so that the seat frame is removably interlocked with the first leg and the second leg so as to form a self-supporting structure.

2. A modular furniture system as recited in claim 1, wherein the first leg further comprises an elongated second engagement channel of the first leg recessed along at least a portion of the top edge of the first leg in substantially parallel alignment with the first engagement channel of the first leg so that the second engagement channel of the first leg extends longitudinally along the top edge of the first leg.

3. A modular furniture system as recited in claim 2, further comprising a furniture component having an edge portion, the edge portion of the furniture component being removably received within the second engagement channel of the first leg.

4. A modular furniture system as recited in claim 3, wherein the furniture component comprises a seat frame or an arm frame.

5. A modular furniture system as recited in claim 1, further comprising a back frame removably mounted to the first leg and the second leg.

6. A modular furniture system as recited in claim 1, wherein the first leg comprises:

a horizontally disposed base portion having a first end and an opposing second end; and a back portion upstanding from the first end of the base portion such that the first leg has a substantially L-shaped configuration.

7. A modular furniture system as recited in claim 6, wherein the base portion and the back portion of the first leg are discrete members that are coupled together.

8. A modular furniture system as recited in claim 1, further comprising:

a cover; and means for removably securing the cover to the seat frame.

9. A modular furniture system as recited in claim 1, further comprising means for preventing the seat frame from sliding on the first leg.

10. A modular furniture system as recited in claim 1, wherein the first side rail and the second side rail are disposed in parallel alignment or diverging alignment.

11. A modular furniture system as recited in claim 1, wherein the first leg and the second leg independently support the seat frame without the required use of fasteners extending between the seat frame and the first leg or second leg.

12. A modular furniture system as recited in claim 1, wherein the first engagement channel of the first leg extends along a substantially entire length of the top edge of the first leg.

13. A modular furniture system as recited in claim 1, wherein the first engagement channel of the first leg extends only along the top edge of the first leg.

14. A modular furniture system comprising:

a back frame comprising a first side panel, a spaced apart second side panel, and at least one brace extending therebetween, each of the first side panel and the second side panel having an inner edge bounding a substantially U- or V-shaped catch;

a first leg having an upstanding portion with an engagement edge disposed between an inside face and an opposing outside face, a first engagement channel of the first leg being recessed along at least a portion of the engagement edge of the first leg so that the first engagement channel of the first leg extends longitudinally along the engagement edge of the first leg, the upstanding portion of the first leg being removably received within the catch of the first side panel so that at least a portion of the inner edge of the first side panel is removably received within the first engagement channel of the first, and a second leg having an upstanding portion with an engagement edge disposed between an inside face and an opposing outside face, a first engagement channel of the second leg being recessed along at least a portion of the engagement edge of the second leg so that the first engagement channel of the second leg extends longitudinally along the engagement edge of the second leg, the upstanding portion of the second leg being removably received within the catch of the second side panel so that at least a portion of the inner edge of the second side panel is removably received within the first engagement channel of the second leg, whereby the first leg and the second leg are interlocked with the back frame so as to form a self-supporting structure.

15. A modular furniture system as recited in claim 14, wherein the first leg and the second leg independently support the back frame without the required use of fasteners extending between the back frame and the first leg or second leg.

16. A modular furniture system as recited in claim 14, further comprising:

the first leg further comprises a base portion extending from the upstanding portion of the first leg, the first engagement channel of the first leg being formed on both the base portion and the upstanding portion of the first leg; and a seat frame comprising a first side rail, a spaced apart second side rail, and at least one brace extending therebetween, the first side rail having a lower edge received within the first engagement channel of the first leg.

17. A modular furniture system as recited in claim 14, further comprising a second engagement channel of the first leg recessed along at least a portion of the engagement edge of the first leg in substantially parallel alignment with the first engagement channel of the first.

18. A modular furniture system as recited in claim 17, further comprising a furniture component having an edge portion, the edge portion of the furniture component being removably received within the second engagement channel of the first leg.

19. A modular furniture system as recited in claim 14, further comprising:

a primary cover mounted on the back frame;

a secondary cover; and means for removably securing the secondary cover to the back frame.

20. A modular furniture system as recited in claim 13, wherein the first side panel and the second side panel are disposed in diverging planes.

21. A modular furniture system as recited in claim 14, further comprising an attachment channel recessed on an outside face of the first side panel and extending substantially along the lower edge thereof.

22. A modular furniture system as recited in claim 14, wherein the upstanding portion of the first leg comprises a front edge, a top edge, and a back edge, the engagement edge of the first leg including the front edge, the top edge, and the back edge of the upstanding portion of the first leg, and the first engagement channel of the first leg extends along at least a portion of each of the front edge, the top edge, and the back edge of the upstanding portion of the first leg.

23. A modular furniture system comprising:

a first leg having a substantially L-shaped configuration with an exposed engagement edge disposed between an inside face and an opposing outside face, a first engagement channel of the first left being recessed along at least a portion of the engagement edge of the first leg so that the first engagement channel of the first leg extends longitudinally along the engagement edge of the first leg;

a second leg having a substantially L-shaped configuration with an exposed engagement edge disposed between an inside face and an opposing outside face, a first engagement channel of the second lee being recessed along at least a portion of the engagement edge of the second leg so that the first engagement channel of the second leg extends longitudinally along the engagement edge of the second leg;

seat frame comprising a first side rail, a spaced apart second side rail, and at least one brace extending therebetween, the first side rail having a lower edge received within the first engagement channel of the first leg and the second side rail having a lower edge received within the first engagement channel of the second leg; and a back frame comprising a first side panel, a spaced apart second side panel, and at least one brace extending therebetween, each of the first side panel and the second side panel having an inner edge bounding a catch, at least a portion of the inner edge of the first side panel and the second side panel being removably received within the engagement channel of a corresponding one of the first leg and second leg such that the first leg, second leg, seat frame and back frame are interlocked so as to form a self-supporting structure.

24. A modular furniture system as recited in claim 23, further comprising an elongated second engagement channel of the first leg recessed along at least a portion of the engagement edge of the first leg in substantially parallel alignment with the first engagement channel of the first leg.

25. A modular furniture system as recited in claim 24, further comprising a furniture component having an edge portion, the edge portion of the furniture component being removably received within the second engagement channel of the first leg.

26. A modular furniture system as recited in claim 23, wherein the catch bounded by the inner edge of the first side panel has a substantially U- or V-shaped configuration.

27. A modular furniture system as recited in claim 23, further comprising:

a cover; and means for removably securing the cover to the back frame.

28. A modular furniture system as recited in claim 23, wherein the first leg and the second leg independently support the seat frame and the back frame without the required use of fasteners extending between any of the seat frame, the back frame, the first leg, and the second leg.

29. A modular furniture system comprising:

a first leg having an engagement edge extending between a first face and an opposing second face, an elongated first engagement channel and an adjacent elongated second engagement channel being recessed along the engagement edge of the first leg in substantially parallel alignment so that the first engagement channel and the second engagement channel extend longitudinally along the engagement edge of the first leg, at least a portion of the first and second engagement channels being separated by a partition ridge;

a first furniture component having an edge portion, the edge portion of the first furniture component being received within the first engagement channel of the first leg; and a second furniture component having an edge portion, the edge portion of the second furniture component being received within the second engagement channel of the first leg, whereby the first furniture component and the second furniture component are interlocked with the first leg so as to form a self-supporting structure.

30. A modular furniture system as recited in claim 29, wherein the first furniture component is selected from the group consisting of a seat, a back rest, and an arm rest.

31. A modular furniture system as recited in claim 29, wherein the first leg has a substantially L-shaped configuration.

32. A modular furniture system as recited in claim 29, wherein the first furniture component and the second furniture component are secured to the first leg without the required use of fasteners extending between any of the first furniture component, the second furniture component, and the first leg.

* * * * *

UNITED STATES PATENT AND TRADEMARK OFFICE

CERTIFICATE OF CORRECTION

PATENT NO. : 6,783,182 B1 
APPLICATION NO. : 10/412048
DATED : August 31, 2004
INVENTOR(S) : Michael S. Gallagher It is certified that error appears in the above-identified patent and that said Letters Patent is hereby corrected as shown below:

Drawings,
Sheet 3, replace Figure 3 with the figure depicted herein below, in which the "springs" have been labeled with --64-- and the "side portion of seat cushion "76" has been labeled with --84--

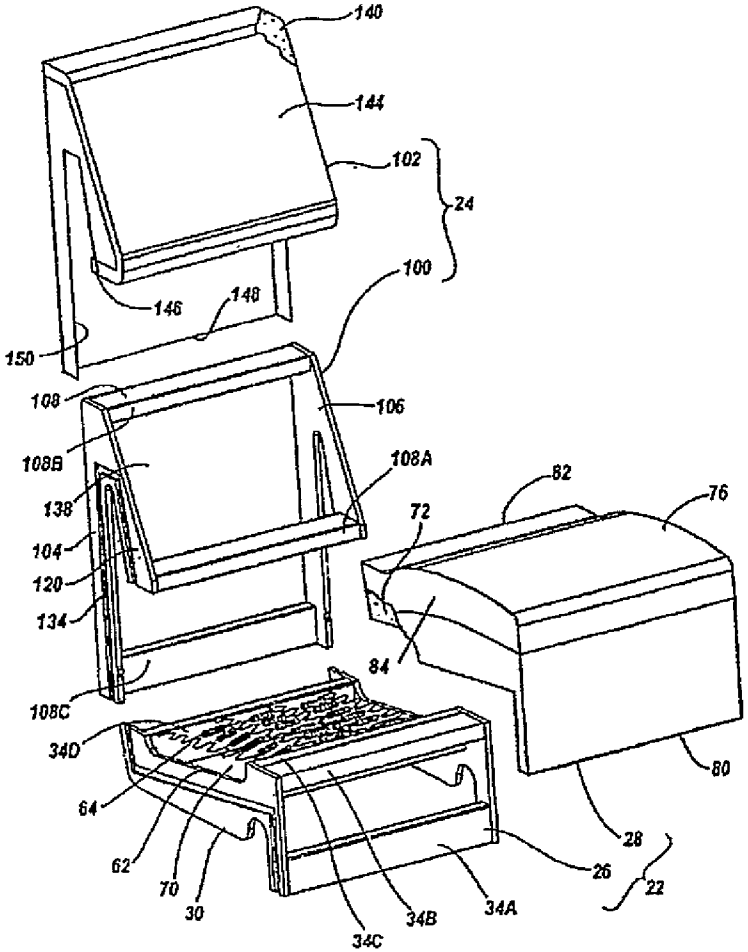

Fig. 3

Column 2,
Line 2, after "side view" change "if" to --of--
Line 34, change "Other dimension" to --Other dimensions--
Line 49, after "formed with" insert --,--
Line 49, after "orthogonally downward from" insert --,--
Line 61, after "along foot section" change "45" to --54--

Column 3,
Line 16, before "Finally," change "oriented, "to --oriented. --
Line 53, before "removably securing" change "from" to --for--

Column 4,
Line 4, after "be replaced" insert --with--
Line 27, after "attachment channel" change "136" to --134--
Line 67, after "front edge 146," change "aback" to --a back--

UNITED STATES PATENT AND TRADEMARK OFFICE

CERTIFICATE OF CORRECTION

PATENT NO. : 6,783,182 B1
APPLICATION NO. : 10/412048
DATED : August 31, 2004
INVENTOR(S) : Michael S. Gallagher It is certified that error appears in the above-identified patent and that said Letters Patent is hereby corrected as shown below:

Column 5,
Line 11, after “present invention” insert --,--
Line 12, before “removably securing” change “from” to --for--
Line 26, after “can be replaced” insert --with--

Column 6,
Line 23, change “That is seat frame 26” to --That is, seat frame 26,--
Line 24, after “thus seat 22” insert --,--
Line 24, change “self-support” to --self-supporting--

Column 7,
Line 2, change “That is back frame 100” to --That is, back frame 100,--
Line 3, after “back rest 24” insert --,--
Line 3, change “self-support” to --self-supporting--
Line 20, change “Ann rests” to --Arm rests--

Column 8,
Line 17, after “That is” insert --,--
Line 22, after “alternative embodiment” insert --,--
Line 26, after “furniture components” insert --,--
Line 51, before “the same configuration” insert --in--
Line 60, after “spaced apart” change “father” to --further--

Column 9,
Line 1, change “father” to --further--

UNITED STATES PATENT AND TRADEMARK OFFICE

CERTIFICATE OF CORRECTION

PATENT NO. : 6,783,182 B1
APPLICATION NO. : 10/412048
DATED : August 31, 2004
INVENTOR(S) : Michael S. Gallagher It is certified that error appears in the above-identified patent and that said Letters Patent is hereby corrected as shown below:

Column 12,
Line 30, after "of the second" change "lee" to --leg--
Line 35, before "seat frame" insert --a--

Signed and Sealed this

Fourth Day of September, 2007

JON W. DUDAS
*Director of the United States Patent and Trademark Office*